United States Patent [19]

Vinot et al.

[11] Patent Number: 4,878,711

[45] Date of Patent: Nov. 7, 1989

[54] METHOD AND APPARATUS FOR MINING OF OCEAN FLOORS

[75] Inventors: Bernard Vinot, Paris; Odile Constant, Chelles, both of France

[73] Assignee: Rhone-Poulenc Chimie, Courbevoie, France

[21] Appl. No.: 155,701

[22] Filed: Feb. 16, 1988

[30] Foreign Application Priority Data

Feb. 16, 1987 [FR] France ..... 87 01913

[51] Int. Cl.[4] ..... E02F 7/00

[52] U.S. Cl. ..... 299/9; 37/DIG. 8

[58] Field of Search ..... 299/8, 9; 37/195, DIG. 8, 37/58; 166/246; 175/65

[56] References Cited

U.S. PATENT DOCUMENTS

| | | | |
|---|---|---|---|
| 2,132,800 | 10/1938 | Payton | 299/9 |
| 2,756,977 | 7/1956 | Temple | 299/8 |
| 3,208,526 | 9/1965 | Patton et al. | 166/246 |
| 3,251,768 | 5/1966 | Walker | 175/65 X |
| 3,319,715 | 5/1967 | Parks | 175/65 X |

FOREIGN PATENT DOCUMENTS

| | | | |
|---|---|---|---|
| 197811 | 11/1978 | Netherlands | 299/8 |
| 253725 | 1/1968 | U.S.S.R. | 37/DIG. 8 |
| 1116290 | 6/1968 | United Kingdom . | |

OTHER PUBLICATIONS

2nd International Colloquium on the Exploitation of the Oceans, "Exploitation des Ressources Minieres Des Oceans avec le Procede De Pompage Par Air-Lift", J. P. Jacquemin, J. F. Lapray, 10-1974.

*Primary Examiner*—Stephen J. Novosad
*Assistant Examiner*—David J. Bagnell
*Attorney, Agent, or Firm*—Burns, Doane, Swecker & Mathis

[57] ABSTRACT

Suboceanic particulate solids containing useful metal values are recovered from ocean floors by extending a recovery tube from above an ocean surface to the ocean floor and confining a column of sea water therein, injecting a pressurized gas into the base of said tube, while separately contemporaneously injecting thereat an aqueous solution of at least one water-soluble, high molecular weight suspension enhancing polymer, whereby forming a diluted dispersion of particulate ocean floor solids and propelling same to the ocean surface, and there recovering said particulate solids from the dilute dispersion.

20 Claims, 2 Drawing Sheets

METHOD AND APPARATUS FOR MINING OF OCEAN FLOORS

BACKGROUND OF THE INVENTION

1. Field of the Invention:

The present invention relates to the mining of undersea formations, and, more especially, to the recovery of oceanic solids containing metal values from deep submarine deposits, e.g., ocean floors.

2. Description of the Prior Art:

Metal bearing deposits present on the surface of certain ground regions, or strata, covered by seawaters and the oceans constitute potentially enormous sources of metallurgical values. These are in widely differing forms, varying from muds rich in metals to polymetallic nodules and metal-containing chimneys. The abundance of valuable metals in these deposits has heightened interest in the industrial exploitation or mining recovery thereof. However, their recovery presents certain obvious economic and technical problems, as such values are located at ocean depths of up to 6,000 meters. Moreover, the dimensions of these solid particulates vary from a few millimeters to tens of centimeters. This, together with their weight, directly affects the efficiency of any recovery/collection thereof.

It has already been considered, on an experimental scale, to apply the airlift pumping method for the mining of suboceanic deposits/formations (J. P. Jacquemin, J. F. Lapray, R. Porte, "IInd International Colloquium on the Exploitation of the Oceans", Bordeaux, Oct. 1–4, 1974).

According to this technique, air is injected into the lower region of a tube partially submerged in a body of water. The gas lightens the column of water confined in the tube and raises its level. Beginning with a certain stream of air, the two-phase mixture escapes at the upper end of the tube, thereby generating or establishing a pumping effect. However, the raising of heavy or large particles, such as boulders, is very difficult at great depths in view of the low suspension capacity of a two-phase air/water mixture.

SUMMARY OF THE INVENTION

Accordingly, a major object of the present invention is the provision of an improved process for the recovery of deep suboceanic mineral values which conspicuously avoids those disadvantages and drawbacks to date characterizing the state of this art.

Briefly, the present invention features the recovery of solid metal values from deep submarine formations by the injection of a gas into the lower end of a column of sea water confined in a tube submerged in the ocean and causing the establishment and entrainment of a dispersion of particulate solids in the water. Consistent therewith, an aqueous solution containing at least one suspension enhancing additive selected from among the high molecular weight, water soluble polymers, is injected and diluted in the dispersion at the base of the column, the dispersed mixture is forced toward the surface by the pressure of the gas, and the solids are then separated therefrom.

DETAILED DESCRIPTION OF THE PREFERRED EMBODIMENTS OF THE INVENTION

More particularly according to the present invention, exemplary of high molecular weight, water soluble polymers having a good suspending power, and suitable for the production of the aqueous solution, are fermented polysaccharides, natural gums, acrylic polymers such as polyacrylamides and polymethacrylamides, cellulose derivatives such as hydroxyethylcellulose and carboxymethylcellulose, and the various mixtures thereof.

Among such polymers, preferred are the polysaccharides of microbial origin, which are products of the fermentation of a carbohydrate under the action of microorganisms, for example bacteria belonging to the genus Xanthomonas, the genus Arthrobacter, the genus Azotobacter, the genus Agrobacterium, the genus Erwinia, the genus Alcaligenes, and fungi belonging to the genus Sclerotium. Xanthan gum is most particularly preferred in view of its excellent stability in sea water, its good suspension capability and its lack of toxicity relative to underwater flora and fauna.

An aqueous solution is advantageously used which contains xanthan gum and at least one other water soluble polymer desirably synergistic therewith as regards the ability for suspending solid particles. As specific examples, mixtures of xanthan gum and of the galactomannans, such as guar gum, carob gum, cassia gum, tara gum and the like, are particularly representative.

The aqueous solution of the polymer may be prepared from a powder or an aqueous concentrate. In one advantageous embodiment of the invention, the solution is prepared at the surface and injected into a flow of gas, with the polymer concentration ranging from 0.5 to 5% by weight as a function of the polymer or polymers, such as to provide, after dilution with the sea water contained in the column, a useful concentration preferably ranging from 0.005 to 0.5% by weight.

Figure 1:
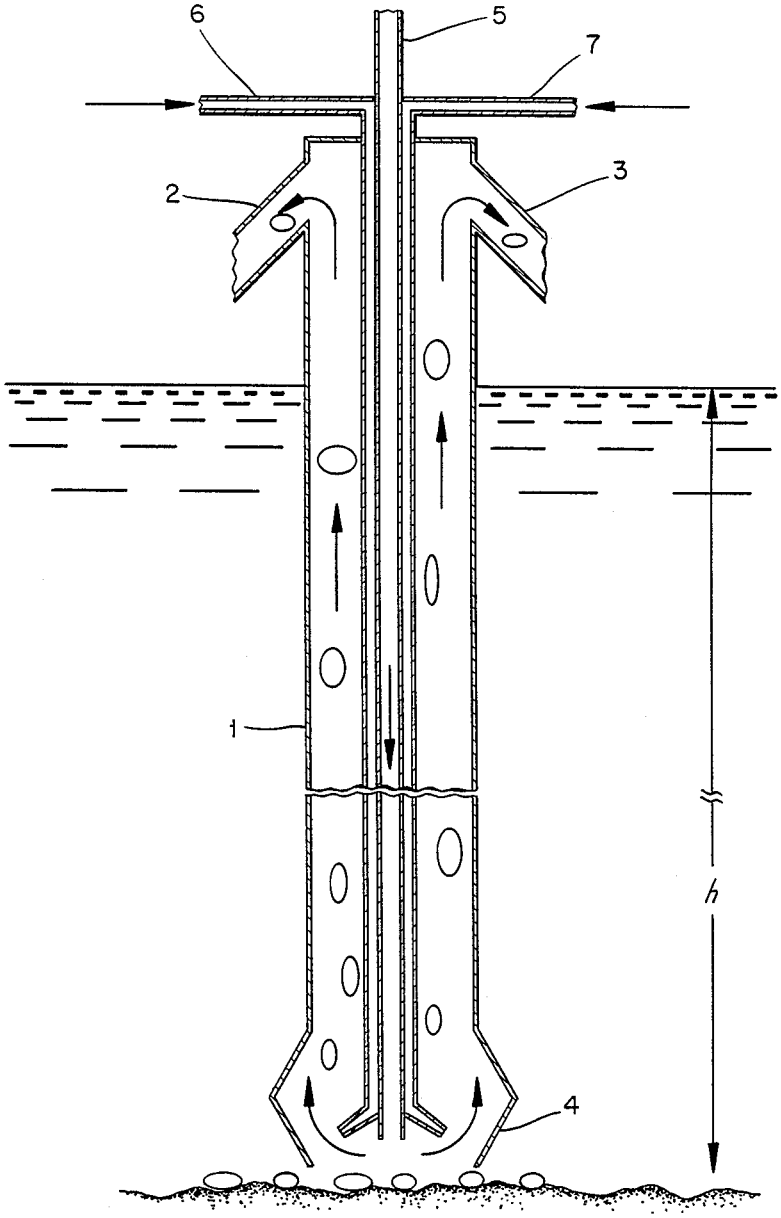
FIG. 1 is a diagrammatic/schematic cross-sectional view of one embodiment of the process/apparatus according to the invention.

Referring specifically to the accompanying FIG. 1, the apparatus according to the invention comprises a principal tube member 1 equipped at its upper end with outlet conduits 2 and 3 and at its base with a mixing chamber 4. The pipes or conduits 2 and 3 may be connected to any means (not shown) for liquid/solid separation. A pipe 5 is mounted in the center of the tube 1 for the introduction of the aqueous polymer solution into the chamber 4. Two lateral conduits 6 and 7, connected with a source of distribution, enable the injection of a gas under pressure into the chamber 4.

The assembly is immersed to a depth h, which in practice is the height between the bottom and the surface of the ocean. The pressure equilibrium equalizes the water level in the tube 1 at the surface level. The process of the invention features injecting a gas, for example air, through conduits 6 and 7 under a pressure $P + \rho gh$, (wherein $\rho$ is the density of the water, and g is the gravity), which makes it possible to initiate the pumping action. Simultaneously, an aqueous solution of the polymer is injected via line 5, at a rate of $q' = aq$, wherein 9 is the rate of the rise of the liquid in the tube 1 and 2 ranges from 0 to 1, preferably from 0.01 to 0.5.

The injected air rises in 1 while lightening the column of water and initiating a pumping effect. The polymer solution is suctioned with the water of the surrounding sea, while entraining the solids to be elevated, which are retained in suspension along their ascending path in the apparatus 1, to the outlet lines 2 and 3. The dispersion is then collected and the valuable solids are separated from the aqueous phase, which may be recycled at level 5.

The use of the polymer has the particular advantage of enhancing the laminar nature of the ascending countercurrent flow, this "laminar" mode being favorable to the rise of the particles in suspension.

In order to further illustrate the present invention and the advantages thereof, the following specific example is given, it being understood that same is intended only as illustrative and nowise limitative of the scope of the claims.

EXAMPLE

An experiment was simulated in the laboratory using the apparatus shown in FIG. 1. The tube 1 had a height of 200 cm and a capacity of 5 liters. The device was confined in a cylindrical envelope filled with sea water to the height of h=180 cm, and at the base of which gravel having a mean dimension of 5 mm and a density of 2.5 was introduced. Air was injected through lines 6 and 7 at a rate of 20 to 27.5 $dm^3$/min. An aqueous solution of 0.5% by weight of xanthan gum (RHODOPOL 23®), was injected through line 5 into the sea water at a rate such that, after dilution with the sea water suctioned therein at level 4, the concentration of the polymer in the water contained in tube 1 Was 0.05%. The solids raised were separated from the dispersion collected at outlets 2 and 3 and the solution was continuously recycled at level 5.

Figure 2:
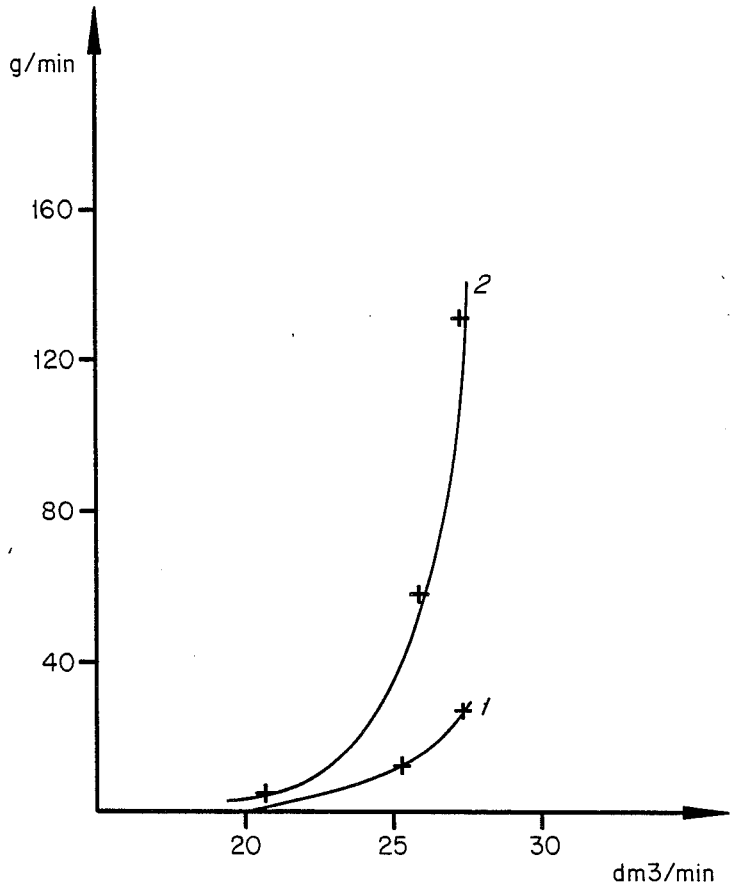
FIG. 2 is a graph comparing the results obtained according to the invention vis-a-vis a process not within the scope of the invention.

The efficiency of the process was determined by measuring the weight of the gravel recovered in g/min as a function of the flow rate of the air. The results are shown in FIG. 2, curve 2, compared to the same experiment carried out under the same conditions, but without using the xanthan gum (curve 1). With a flow of air of 27.5 $dm^3$/min, according to the invention 130 g of solids were collected per minute, instead of 28 g per minute in the absence of xanthan gum. This constitutes an increase in yield by a factor of 4.5.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A process for the mining of ocean floors, comprising arranging a recovery tube so as to extend between an ocean surface and the ocean floor and confining a column of sea water therein, injecting a pressurized gas into said tube, while separately contemporaneously injecting an aqueous solution of at least one water-soluble, high molecular weight suspension enhancing polymer into a base of said tube so as to form a diluted dispersion of particulate ocean floor solids, conveying the diluted dispersion towards the ocean surface, and recovering said particulate solids from the diluted dispersion.

2. The process as defined by claim 1, wherein said water-soluble polymer comprises a biopolysaccharide, natural gum, acrylic polymer, cellulose derivative, or mixture thereof.

3. The process as defined by claim 2, wherein said water-soluble polymer comprises xanthan gum.

4. The process as defined by claim 3, wherein the dispersion further comprises a galactomannan.

5. The process as defined by claim 1, wherein the concentration of the water-soluble polymer in the aqueous solution ranges from 0.5 to 5% by weight.

6. The process as defined by claim 1, wherein the concentration of the water-soluble polymer in the diluted dispersion ranges from 0.005 to 0.5% by weight.

7. The process as defined by claim 1, wherein said pressurized gas comprises air and an upper end of said recovery tube extends above the ocean surface.

8. The process as defined in claim 1, wherein the additive and the pressurized gas are injected at respective rates which cause the diluted dispersion to rise in the recovery tube in a laminar manner.

9. The process of claim 1, further comprising the step of adding the water-soluble polymer to the aqueous solution in powder form.

10. The process of claim 1, further comprising the step of adding the water-soluble polymer to the aqueous solution in an aqueous concentrate form.

11. An apparatus for the recovery of suboceanic particulate solids, comprising a recovery tube adapted to extend between an ocean surface and the ocean floor and confine a column of sea water therein, gas injecting means for injecting a stream of pressurized gas within the recovery tube, additive injecting means separate from said gas injection means for injecting a liquid suspension enhancing additive within the recovery tube at a location adjacent a base thereof, mixing means at the base for forming a dispersion of particulate ocean floor solids and the additive which is conveyed towards the ocean surface by gas rising in the recovery tube and separating means for separating said particulate solids from said dispersion.

12. The apparatus of claim 11, wherein the mixing means comprises a mixing chamber wherein the sea water and the particulate solids are entrained with the additive due to suction created as the gas injected into the recovery tube rises in the recovery tube.

13. The apparatus of claim 11, further comprising means for returning the additive separated from the particulate solids by the separating means to the additive injecting means for reuse thereof.

14. The apparatus of claim 12, wherein the additive injecting means includes a pipe having an opening within the mixing chamber and the gas injecting means includes at least one conduit having an opening within the mixing chamber.

15. The apparatus of claim 14, wherein the at least one conduit comprises a pair of conduits, each of which has an opening within the mixing chamber.

16. The apparatus of claim 15, wherein the pipe is mounted centrally in the recovery tube and the conduits extend along opposite sides of the pipe.

17. The apparatus of claim 11 wherein the recovery tube includes at least one outlet at an upper portion thereof through which the dispersion is pumped due to the injected gas which rises in the recovery tube.

18. The apparatus of claim 11, further comprising an aqueous solution of at least one water-soluble, high molecular weight suspension enhancing polymer which is injected by the additive injecting means.

19. The apparatus of claim 18, wherein the water-soluble polymer comprises a biopolysaccharide, natural gum, acrylic polymer, cellulose derivative, or mixture thereof.

20. The apparatus of claim 18, wherein the water-soluble polymer comprises xanthan gum.

* * * * *